US005794617A

United States Patent [19]

Brunell et al.

[11] Patent Number: 5,794,617

[45] Date of Patent: Aug. 18, 1998

[54] FACE MASK AND RETAINER

[75] Inventors: Robert Brunell; Joseph Zdrok, both of Webster, Mass.

[73] Assignee: Louis M. Gerson Co., Inc., Middleboro, Mass.

[21] Appl. No.: 731,704

[22] Filed: Oct. 17, 1996

Related U.S. Application Data

[60] Provisional application No. 60/005,368 Oct. 19, 1995.

[51] Int. Cl. [6] ..... A62B 18/02

[52] U.S. Cl. ..... 128/206.16; 128/206.12; 128/206.17; 128/206.24; 128/206.26

[58] Field of Search ..... 128/206.17, 206.24, 128/206.12, 206.16, 206.19, 206.21, 206.23, 205.25, 206.26

[56] References Cited

U.S. PATENT DOCUMENTS

| | | | |
|---|---|---|---|
| 2,823,671 | 2/1958 | Garelick | 128/206.17 |
| 2,917,045 | 12/1959 | Schildknecht et al. | 128/206.24 |
| 3,042,035 | 7/1962 | Coanda | 128/206.24 |
| 4,960,121 | 10/1990 | Nelson et al. | 128/206.24 |
| 5,003,633 | 4/1991 | Itoh | 128/206.24 |
| 5,080,092 | 1/1992 | Tenna | 128/206.24 |

FOREIGN PATENT DOCUMENTS

| | | | |
|---|---|---|---|
| 8701950 | 4/1987 | WIPO | 128/206.24 |

*Primary Examiner*—Vincent Millin
*Assistant Examiner*—V. Srivastava
*Attorney, Agent, or Firm*—Wolf, Greenfield & Sacks, P.C.

[57] ABSTRACT

A retainer is provided for a face piece that has a generally triangular face shaped rim for forming a seal over user's face when the face piece is worn. The retainer is made from a stiff material and has a rim that conforms to the rim of the face piece, and is shaped to provide a loose frictional fit over the face piece. The retainer helps protect the face piece during shipping, storage, and when otherwise not in use, and can help correct minor deformation in a face piece.

13 Claims, 2 Drawing Sheets

FACE MASK AND RETAINER

RELATED APPLICATION

This application claims the benefit of U.S. Provisional application Ser. No. 60/005,368 filed 19 Oct., 1995.

FIELD OF THE INVENTION

This invention relates to face masks.

BACKGROUND OF THE INVENTION

A face mask, such as a respirator, has a face-shaped face piece that fits over and seals a user's nose and mouth from the environment to protect the user from breathing particulates or other unwarranted materials, gases or fluids. Some face pieces often have deformable mask material, often of rubber-like material, that provides a good seal with the face while also providing comfortable softness. Problems sometime arise in shipping and storing such masks in that they tend to deform and thus lose their ability to seal properly with the face of a user.

SUMMARY OF THE INVENTION

The present invention features a retainer for protecting and/or shaping a deformable face piece when it is shipped, stored, or otherwise not in use. The retainer fits over the face piece and protects it so that the face piece retains its shape against heat or physical pressure that can otherwise deform it. It can also help a slightly deformed face piece regain its original and intended shape.

A typical face piece to be protected by the retainer of this invention is preferably made of a resilient polymeric material that has a durometer preferably in a range of about 35–65 Shore A. The material is thick enough to be durable and thin enough to be deformable, preferably in the range of about 0.03–0.125 inches. The face piece has outer sides defining an interior of the face piece and a face shaped rim that fits against a user's face when worn and defines a face-shaped opening. As used here, "face shaped" refers to a shape that fits over a user's nose and mouth, and preferably is a generally triangular shape with rounded corners to seal with the cheeks and under the chin of a user.

The retainer of this invention is preferably made with appropriate material and dimensions so that it is substantially shape retaining and/or nondeformable under normal physical and thermal forces in shipping and storing. The material can be a plastic, such as styrene, styrene copolymers such as styrene acrylonitrile, polyet lene terephthalate (PETC), polyvinyl chloride PVC, polypropylene or other organic plastic. Other stiff or shape retaining materials such as molded formed cardboard, metal or the like could be used for the retainer but are not as desirable as plastics. The retainer is preferably between about 0.0075–0.06 inches thick, and more preferably about 0.01–0.02 inches thick but could be of substantially greater thickness. The retainer also has a face shaped conforming rim that fits over and conforms to the rim of the face piece. The retainer is shaped to fit over the face piece with a loose frictional fit such that it does not fall off the face piece without user assistance, but is easily manually removable. The retainer can be made to completely cover the face shaped opening, in which case it helps keep out dust and other foreign matter when not in use.

According to the method of this invention, a face mask having a deformable face shaped face piece with a rim performing a seal with the user's face when the face mask is worn is fitted with a retainer to maintain the face piece rim in proper shape and/or return it to proper shape. The method is carried out by positioning the face piece to engage a retainer. A substantially nondeformable retainer having a rim that has a shape that is similar to and mating with the rim of the face piece is positioned in opposition to the face piece and then pressed into place for conforming the retainer to the rim of the face piece and maintaining it in position for storage and/or shipment.

The retainer of this invention is designed for use with a face piece of a face mask that has a rim for sealing a user's face when worn. The retainer has a face shaped rim for mating over and conforming to the rim of the face piece with the retainer being substantially nondeformable to protect, preserve and maintain in place the face mask rim.

BRIEF DESCRIPTION OF THE DRAWINGS

Other features and advantages will become apparent from the following detailed description when read in conjunction with the drawings in which.

DETAILED DESCRIPTION

Figure 1:
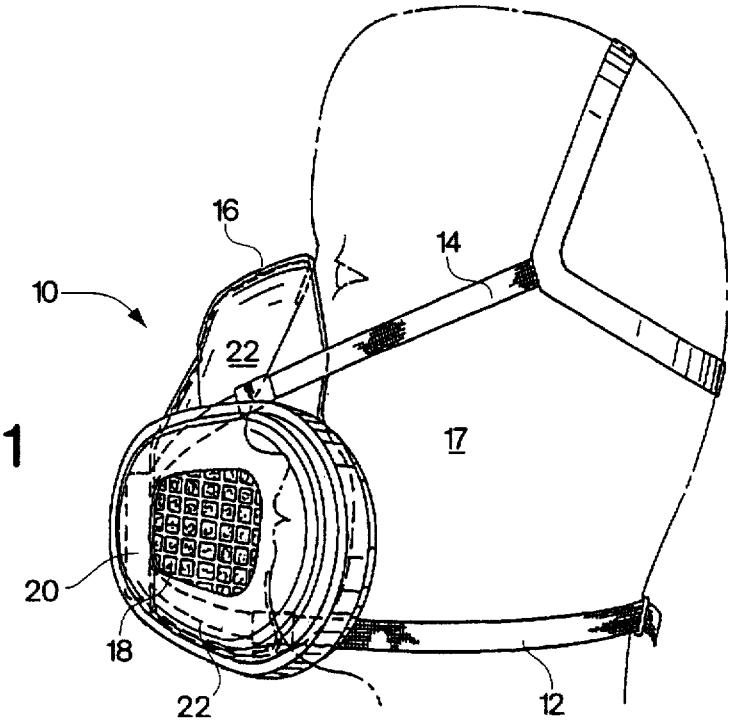
FIG. 1 is a side view of a known face mask, shown as worn by a user.
Figure 3:
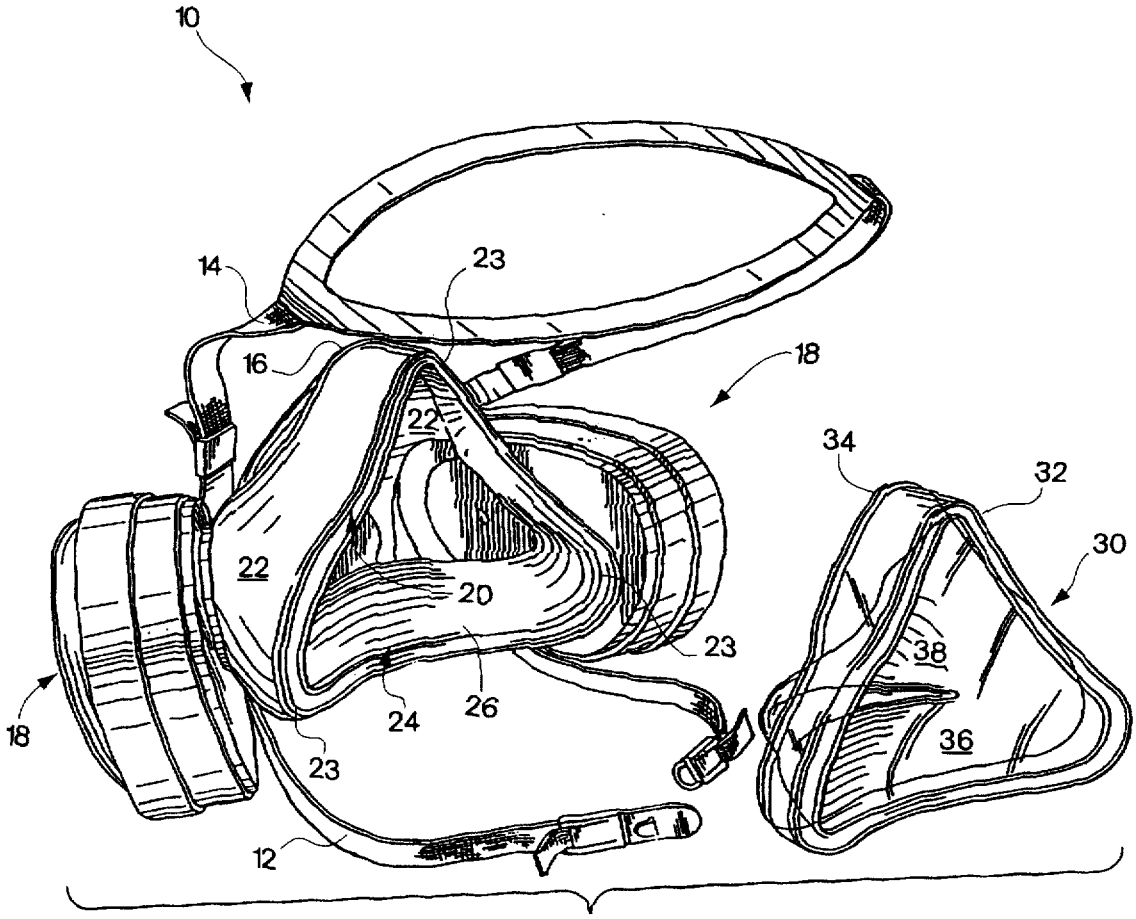
FIG. 3 is an exploded perspective view of a mask and retainer according to the present invention.

Referring to FIGS. 1 and 3, a representative, conventional face mask 10 is shown held against a user's face 17 with upper and lower adjustable, elastic straps 12, 14 so that a face piece 16 having a face shaped rim 24 covers and seals the user's nose and mouth. When the mask is worn, the user inhales filtered ambient air through preferably removably mounted conventional filters 18, which are positioned on the sides of the face mask, and exhales air through a conventional flapper an outflow valve 20 at the front of the mask. To comfortably conform to the user's face, the face piece is preferably made at least in part from a soft, deformable, preferably resilient or elastomeric material, and can be made in small, medium, or large sizes to accommodate different users.

Figure 2:
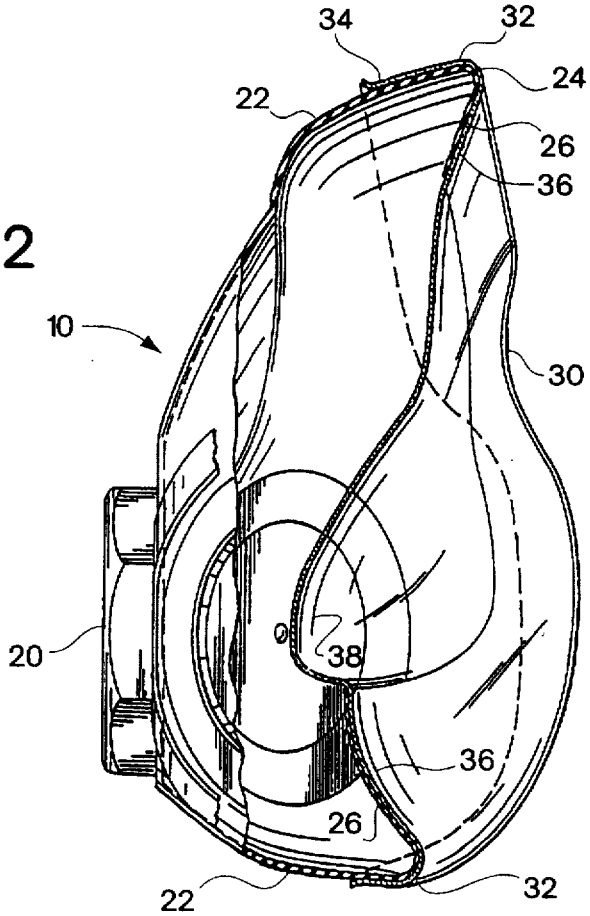
FIG. 2 is a fragmentary cross-sectional view of a mask as shown in FIG. 1 and retainer of a preferred embodiment of this invention with portions removed from the mask.

Referring to FIGS. 2 and 3, the face piece 16 has three triangularly arranged outer sides 22 that make up a generally triangular shape having two side walls and a bottom side wall with rounded corners 23 therebetween and define an interior of the face piece, a rim 24 that defines a face shaped opening, and a bent back portion 26 that extends from the rim toward the interior of the face piece. Although the face mask 10 is in the generally triangular shape, other conventional face mask shapes can be used.

The face piece is made from a molded polymeric elastomeric material as by compression, injection or vacuum molding of materials, such as polyvinylidene chloride, natural rubber, synthetic rubbers such as silicone, neoprene, PVC, or urethane. A preferred material is "Monprene" (a registered trademark of QST Inc., St. Albans, Vt.), an elastomeric thermoplastic that has a durometer of about 45–50 shore A (ASTM D-2240). The face piece has a preferred thickness between about 0.015 to 0.125 inches, and is preferably at least about 0.032 inches.

As shown in FIG. 2, the thickness can vary within a single face piece from about 0.032 at the inner edges of the bent back portion 26 to provide greater flexibility, to about 0.125 at the outer sides 22 where greater support is needed. At such thickness and durometer, the material of the bent back portion 26 has sufficient durability, softness, and deformability to comfortably form a good seal with the face of a user, while not being too flimsy.

When not in use on the face, under pressure or heat, the face piece can become so deformed that it loses its face shape and does not form an adequate seal. Referring to FIG. 2 and particularly to FIG. 3, to prevent such deformation, a retainer 30 is provided over the face piece for shipping, storage, or whenever the face mask is otherwise not being worn. The retainer has a rim 32 that has a shape similar to that of the rim 24 of the face piece, a bent over portion 34 extending around rim 32 for conforming to the outer sides of the face piece, an inner rim portion 36 for conforming to the bent back portion 26 of the face piece, and a central nose portion 38. The nose portion extends inward toward the outflow valve over the lower portion of the bent back portion.26. The retainer thus forms a cover over the interior of the face mask and helps prevent foreign matter from getting in the lace piece when the retainer is positioned over the face piece.

The retainer is made from a stiff material, such as styrene, styrene acrylonitrile, other styrene copolymers, polyethylene terephthalate, or preferably a polyvinyl chloride, such as Mirrex 1002/1012, available from American Mirrex Corp., New Castle, Del. The retainer has a thickness that is preferably in the range of about 0.0075–0.02 inches, and is preferably about 0.05–0.06 inches thick. At the more preferable range, the retainer is sufficiently stiff and nondeformable without using too much excess and unneeded material.

It is not necessary for the bent over portion 34 to extend all the way around the retainer; it is desirable, however, for there to be sufficient portions to help frictionally hold the retainer to the face piece. In some cases, rather than being continuous and encircling as in FIG. 3, a discontinuous flange 34 can act as spring clips to hold the retainer on the rim 24. The resilient nature of the rubber like rims 24 of the mask enables the rim 34 to resiliently interlock the mask and retainer. The frictional fit should be loose enough to allow the retainer to be easily manually removed from or positioned over the face piece, but sufficient enough to hold the retainer to the face piece when positioned over it. The frictional fit should be tight enough so that it stays on the face piece and sufficient to overcome gravitational forces so that if the combined face mask and retainer is held so that the outflow valve 20 faces up and the retainer faces down, the retainer stays in place.

In addition to protecting the face piece, it has been found that if the face piece is slightly deformed, the original shape of the face piece can be at least partially restored by providing the retainer over the face piece for a period of time at ambient temperature or the temperature at which deformation took place.

Having disclosed an embodiment of the present invention, it should become apparent that modifications and alterations can be made without departing from the scope of the appended claims.

For example, other variations in the shape, material, and thickness of the face piece may be possible so long as it covers and seals the nose and mouth. While in the preferred embodiment the retainer has a nose portion, the nose area of the retainer could have an opening and the retainer can have only port 34 and 36, as long as the retainer is substantially nondeformable when positioned over the face piece. By having a nose area that is a continuous aperture-free sheet that covers the face shaped opening completely, the retainer keeps foreign matter out of the face piece. While the thickness of the retainer has been given limits, the thickness can vary greatly and the retainer can be stiffer; the given range has been found to have sufficient stiffness without using excess material. The retainer is preferably a vacuum formed organic polymer material to provide an inexpensive, easily fabricated retainer. However, the retainer can be molded or formed by other well-known methods. The rim of the face mask of the preferred embodiment is bent back; however, the rim can be an encircling head or other shape which enables a retainer rim to be resiliently held in place. The face mask resiliency or the resiliency of the retainer material or form can be used to hold the retainer in the position as shown in FIG. 2.

What is claimed is:

1. A face mask comprising:

a deformable resilient face shaped, face piece having at least one outer wall carrying at least one exhalation valve and at least one inhalation valve;

an encircling rim formed by said face piece shaped to contact and conform to a user's face to form a seal against said face when the mask is worn by the user;

said rim having an edge defined by outer face piece walls extending away from the rim, said face piece defining an interior portion of the face piece forming a breathing chamber, an encircling bent back rim portion extending from the rim and toward the interior of the face piece;

a removable and replaceable retainer for positioning over the rim of said face piece during shipping or storage and comprising:

a conforming rim for positioning over the bent back rim of the face piece, and a bent over confirming rim portion extending from the conforming rim for conforming to at least part of said outer face piece walls and for forming a frictional fit between the face piece and the retainer, the retainer being substantially nondeformable under normal conditions of use.

2. The face mask of claim 1, wherein the retainer is made from a molded plastic sheet.

3. The face mask of claim 2, wherein the retainer is made from a material selected from a group consisting of polyethylene terephthalate, polyvinyl chloride, polystyrene, styrene containing polymers or mixtures thereof.

4. The face mask of claim 2, wherein the bent over rim portion and rim are shaped to provide a frictional fit that is loose enough so that the retainer is easily manually removable from the face piece, and tight enough so that the retainer does not separate from the face mask without user assistance.

5. The face mask of claim 4, wherein the retainer has a thickness of between about 0.0075 and about 0.02 inch.

6. The face mask of claim 4, wherein the retainer has a thickness of between 0.05 and 0.06 inch.

7. The face mask of claim 1, wherein the bent over rim portion extends completely around the rim of the retainer.

8. The face mask of claim 1, wherein the bent back rim defines an opening, wherein the retainer completely covers said opening.

9. A retainer for a resilient, deformable face piece of a face mask which face piece has a rim shaped for directly sealing against a user's face when worn, and has outer face piece walls, a removable and replaceable retainer for positioning over the rim of said face piece during shipping or storage and comprising:

a conforming rim for positioning over the rim of the face piece, and a bent over conforming rim portion extending from the conforming rim for conforming to at least part of said outer face piece walls and for forming a frictional fit between the face piece and the retainer, the retainer being substantially nondeformable under normal conditions of use.

10. The retainer of claim 9, wherein the retainer is made from a molded plastic sheet.

11. The retainer of claim 10, wherein the retainer has a thickness of between 0.0075 and 0.02 inches.

12. The retainer of claim 11, wherein the thickness is between 0.05 and 0.06 inches.

13. A method for protecting a face mask having a deformable face-shaped face piece having a rim for forming a seal with a user's face when the face mask is worn, the method comprising the step of:

positioning over the face piece, a substantially nondeformable, removable retainer having a rim that has a shape that is similar to the shape of the rim of the face piece for conforming to the rim of the face piece, and shipping or storing said face mask and retainer.

* * * * *